US010697640B2

(12) United States Patent
Best

(10) Patent No.: US 10,697,640 B2
(45) Date of Patent: Jun. 30, 2020

(54) DEVICE AND METHOD FOR DECREASING RADIATIVE HEAT FLUX OF INFRARED ENERGY

(71) Applicant: Rachael Kearse Best, Columbia, SC (US)

(72) Inventor: Rachael Kearse Best, Columbia, SC (US)

( * ) Notice: Subject to any disclaimer, the term of this patent is extended or adjusted under 35 U.S.C. 154(b) by 85 days.

(21) Appl. No.: 15/814,977

(22) Filed: Nov. 16, 2017

(65) Prior Publication Data

US 2018/0135861 A1 May 17, 2018

Related U.S. Application Data

(60) Provisional application No. 62/423,520, filed on Nov. 17, 2016.

(51) Int. Cl.

| | |
|---|---|
| ***F24C 3/00*** | (2006.01) |
| ***F24C 1/08*** | (2006.01) |
| ***F24C 3/04*** | (2006.01) |
| ***F23D 14/12*** | (2006.01) |

(52) U.S. Cl.

CPC ..... *F24C 1/08* (2013.01); *F23D 14/12* (2013.01); *F23D 14/125* (2013.01); *F24C 3/047* (2013.01); *F23D 2900/14121* (2013.01); *F23D 2900/14125* (2013.01)

(58) Field of Classification Search

USPC ..... 431/326–329

See application file for complete search history.

(56) References Cited

U.S. PATENT DOCUMENTS

| | | | | |
|---|---|---|---|---|
| 3,098,477 A * | 7/1963 | Lotter | ..... | A47J 37/06 126/41 R |
| 4,798,192 A * | 1/1989 | Maruko | ..... | F24C 1/10 126/91 A |
| 8,227,728 B2 | 7/2012 | Best | | |
| 8,770,181 B2 | 7/2014 | Best | | |

OTHER PUBLICATIONS

Brewster, M. Quinn. Thermal Radiative Transfer and Properties. Wiley, 1992. pp. 17 (Year: 1992): Appendix A.*

Brewster, M. Quinn. Thermal Radiative Transfer and Properties. Wiley, 1992. pp. 17 (Year: 1992): Fraction Function.*

* cited by examiner

*Primary Examiner* — Vivek K Shirsat

(74) *Attorney, Agent, or Firm* — B. Craig Killough; Barnwell Whaley Patterson & Helms

(57) ABSTRACT

A method and device utilizing infrared energy for heating objects, while providing energy control and enabling a decrease radiative heat flux (or intensity) of the infrared energy. An infrared emission device providing reduction of radiative heat flux or intensity from a primary emitter according to the invention may comprise a heat source, a primary emitter that emits infrared radiation of a first wavelength, and a secondary emitter that is spaced apart from the primary emitter. The secondary emitter receives infrared radiation emitted from the primary emitter and emits infrared radiation. The secondary emitter is constructed and arranged to emit infrared radiation having a wavelength that is longer than the infrared radiation of the first wavelength.

34 Claims, 3 Drawing Sheets

DEVICE AND METHOD FOR DECREASING RADIATIVE HEAT FLUX OF INFRARED ENERGY

Applicant claims the benefit of U.S. Provisional Application Ser. No. 62/423,520 file Nov. 17, 2016.

BACKGROUND

It is widely accepted that infrared energy is superior to other forms of heat energy for certain industrial curing and drying processes. In the past 10-15 years, infrared energy generated from fuels such as butane, propane and natural gas has also become popular for use in outdoor grills and for indoor grills used in restaurants. All of these gas fired grills depend upon the combustion of a gaseous fuel for the generations of infrared energy. It is quite simple to achieve radiative heat flux levels high enough to sear meat and to cook it quickly. Such meats include steaks, chops, hamburgers, ribs and small roasts. A hamburger with a diameter of about 5 inches (12.7 cm) and % inch (1.3 cm) thickness weighing about 0.40 pounds (0.18 kg) can be broiled to an internal temperature of 160° F. (71° C.) in less than 10 minutes.

All gas burners that depend on a venturi or an air injector tube to introduce primary air for combustion have a minimum fuel input for low fire. This restriction limits most infrared energy types of grills for use in slow cooking over an extended period of time because the limitation of the turn down ratio does not allow the infrared energy to be reduced to a level required—less than a total emissive power of about 1000 BTU/HR $FT^2$—for traditional slow cooking, barbecuing, and smoking that can take up to 12-14 hours or more.

A growing interest in slow cooking and smoking in recent years has spawned a rapidly growing sector of the outdoor cooking equipment industry, a sector which includes traditional smokers as well as kamado-style ceramic cookers and pellet grills. However, these types of cookers are not capable of reaching the high searing temperatures of infrared grills. An apparatus that can reduce the total emissive power of infrared grills and can be installed on and removed from a grill easily would make infrared grills far more versatile by enabling consumers to slow cook and smoke as well as sear on the same piece of cooking equipment.

SUMMARY OF THE INVENTION

The present invention is a method and device utilizing infrared energy for heating objects, while providing energy control and enabling a decrease radiative heat flux (or intensity) of the infrared energy. An infrared emission device providing reduction of radiative heat flux or intensity from a primary emitter according to the invention may comprise a heat source, a primary emitter that emits infrared radiation of a first wavelength, and a secondary emitter that is spaced apart from the primary emitter. The secondary emitter receives infrared radiation emitted from the primary emitter and emits infrared radiation. The secondary emitter is constructed and arranged to emit infrared radiation having a wavelength that is longer than the infrared radiation of the first wavelength.

DESCRIPTION OF EMBODIMENTS OF THE INVENTION

This invention includes a method and device for diminishing radiative heat flux (or intensity) of infrared energy. Devices for accomplishing the diminished radiative heat flux (or intensity) of infrared energy according to the invention preferably reduce the infrared energy emitted from a first or primary emitter 2 to below a total emissive power of 936 BTU/HR $FT^2$ for all wavelengths, wherein more than 50% of the wavelengths are in excess of 8 microns. The infrared radiative heat flux limiter is referred to herein as a secondary emitter 4.

Figure 1:
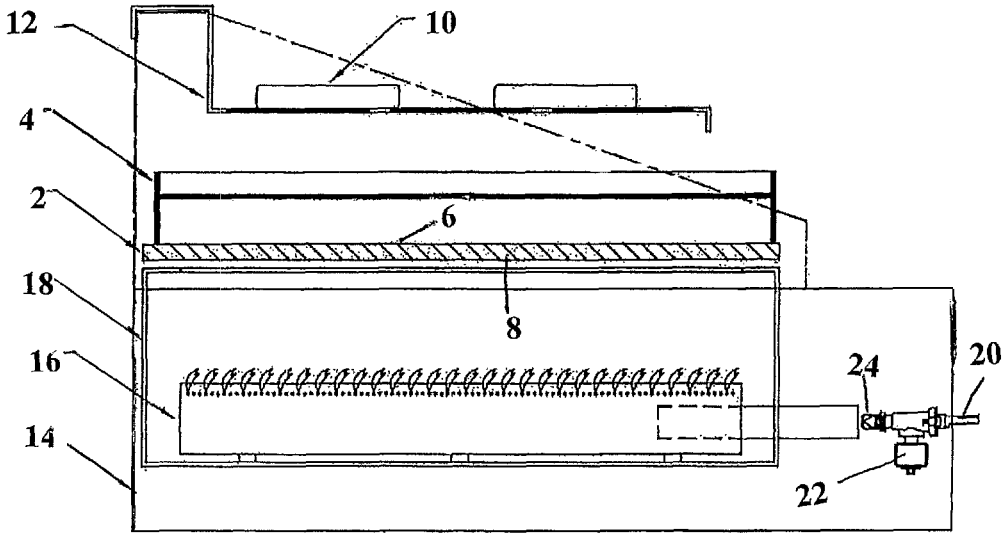
FIG. 1 is a sectioned side elevation of a device according to an embodiment of the invention.

A preferred embodiment of the invention comprises a plate (secondary emitter 4) that is interposed between a primary emitter 2 of infrared energy and the energy absorbing object(s) 10. FIG. 1. By way of example, the energy absorbing objects may be food that is supported on a support member 12. The invention decreases the radiative heat flux (or intensity) from the primary emitting source by absorbing infrared energy emitted by the primary emitter and reradiating the infrared energy at longer wavelengths, based on the secondary emitter's radiant properties, thereby decreasing the temperature and/or decreasing emissivity of the secondary emitter from that of the primary emitter. The intensity of the energy transmitted to the object, such as food, is decreased. In some applications, both temperature decrease and decreased emissivity are employed.

The materials from which the primary emitter 2 and the secondary emitter 4 may be constructed included metal, glass, ceramic glass, ceramic and other material that has the ability to operate at temperatures up to approximately 500° F. (260° C.). The form of the plate may be flat or have a small curvature. The plate may be fabricated with side walls in a pan-like structure to add rigidity. Support ridges may be pressed or otherwise formed in the plate to increase rigidity and diminish warping resulting from expansion during heating. The plate may have a plurality of apertures formed in a surface of the plate that allow passage of some infrared radiation from the primary emitter(s) but block other infrared radiation.

This invention is believed to be of particular benefit when the fuel provided for combustion and heat generation is a combustible gas, such as propane, butane or natural gas. Gas burners inherently have a limit with regard to reducing heat output. That is, such burners have a turn down limitation that is associated with combustibility of the gas-air mixture. When this limitation is exceeded, the burner's flame is extinguished, and combustion and energy generation is terminated. The invention diminishes the intensity, or radiative heat flux, of infrared energy when low levels of such energy are desirable in an application but cannot be attained by adjustment of the fuel input to the burner.

Figure 2:
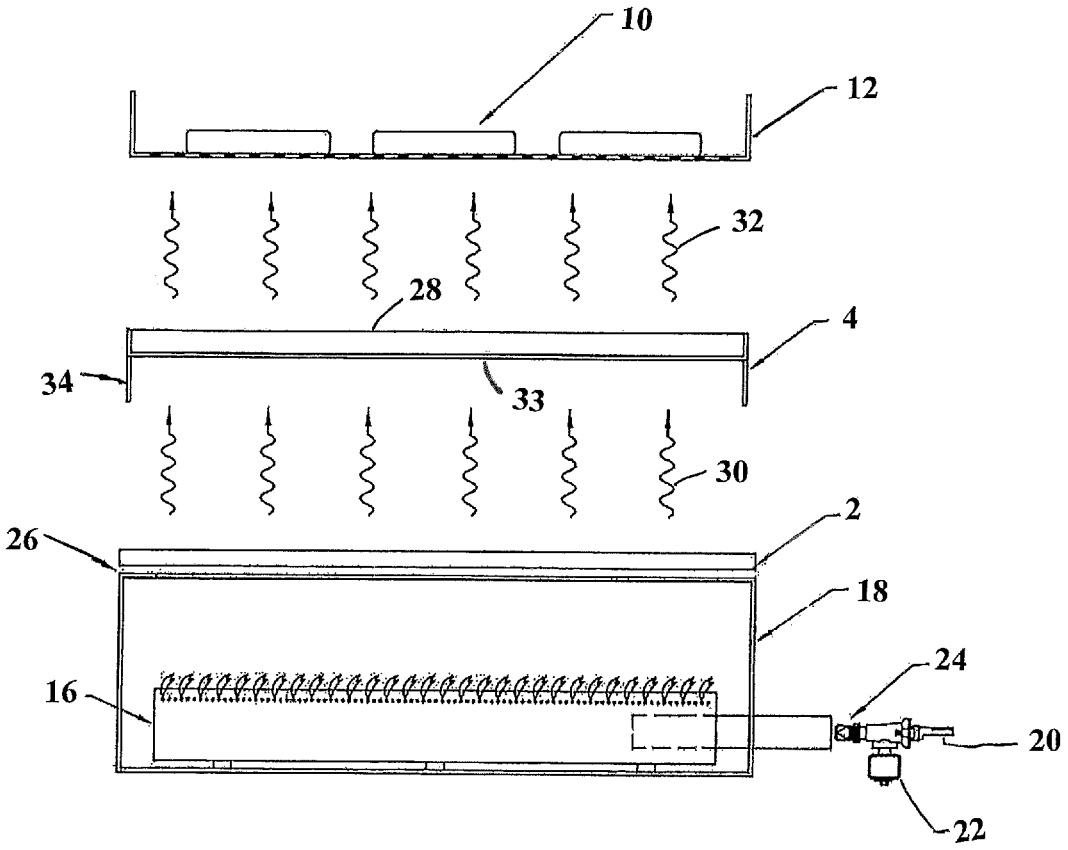
FIG. 2 is an exploded view showing elements of a device according to an embodiment of the invention.

As shown in the embodiment of FIG. 1 and FIG. 2, a housing 14 has a burner 16 and a combustion plenum 18. A gas inlet 20 and regulator 22 are provided. Combustible gas is mixed with air and ignited at sufficient temperature. Air may be provided through orifice 24. The burner emits flame and products of combustion into the combustion plenum. An exhaust port 26 may be provided. Also emitted is infrared energy. The primary emitter 2 receives the infrared energy at a first, or lower, surface 8 of the primary emitter. The primary emitter emits infrared energy of a first wavelength 30 from a top, or upper, surface 6 of the primary emitter. The secondary emitter 4 receives the infrared energy from the primary emitter on a lower surface of the secondary emitter 33. The secondary emitter is constructed and arranged to emit at least 50% of its infrared energy from the top surface 28 at a wavelength 32 that is longer than the first wavelength emitted by the primary emitter.

In a preferred embodiment, the device according to the invention is a grill. A grill may be built generally in accordance with the grill shown in Best, U.S. Pat. No. 6,114,666, and modified with a secondary emitter according to the present invention. An example of the effect of the invention on a grill so constructed is as follows: A test indicates that the temperature of the primary emitter on low fire setting was 540° F. (271° C.), while the temperature of the secondary emitter was 320° F. (160° C.). Output radiation flux density based on the Stefan-Boltzman equation is stated as follows for this application.

$$Q=0.173\times10^{-8}\times e\times A(T_1^4-T_2^4)$$

$$Q=BTU\backslash HR$$

$0.173\times10_{-8}$=Stefan-Boltzman Constant $e$=emissivity $A$=Area\FT$^2$ $T_1^4={}^{\circ}R^4$(emitting surface temperature)

$T_2^4={}^{\circ}R^4$(absorbing surface temperature)

Note: When computing radiative heat flux use only $T_1^4$.

Solving the above equation for the primary emitter with a temperature of 520° F. (271° C.) and an emissivity of 0.92 indicates that the total emissive power of the primary emitter is 1575 BTU/HR FT$^2$ and for the secondary emitter with a temperature of 320° F. (160° C.) and emissivity of 0.92 indicates the total emissive power of the secondary emitter is 582 BTU/HR FT$^2$.

The present invention according to a preferred embodiment comprises a secondary emitter 4. The secondary emitter may be a metal plate in one embodiment. The metal plate may have side walls (pan-like) for support, with walls about the entire perimeter of the secondary emitter. A first side (lower surface) of the secondary emitter 33 that faces the primary emitter is an absorbing side that absorbs infrared energy from a primary emitter. The obverse side 28 of the secondary emitter, which may be a metal plate, emits infrared energy 32 absorbed by the first side of the metal plate 33. FIG. 2. Heat tolerant or heat resistant coatings of different types may be applied on one or both sides to vary the emissivity to achieve the desired result of reducing the emissive power of the primary emitter. For example, the coatings may be ceramic, porcelain or high temperature paint that will withstand the operating temperatures.

Figure 3A:
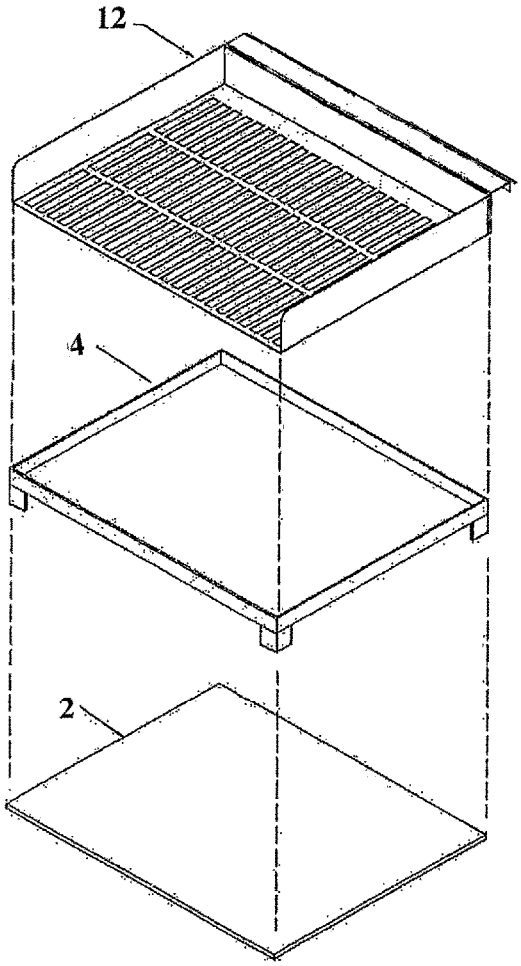
FIG. 3A is a perspective, but exploded, view showing elements of a device according to an embodiment of the invention.
Figure 3B:
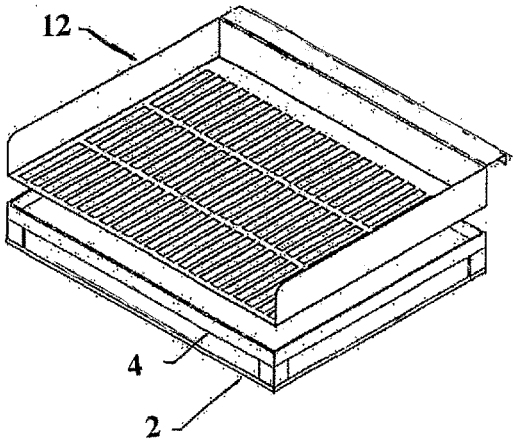
FIG. 3B is a perspective view showing the elements of a device according to the embodiment of the invention of FIG. 3A in relationship for use.

The secondary emitter 4 is preferred to be spaced apart from the primary emitter 2. For example, the secondary emitter may be spaced ½ inch (1.3 cm) to 5 inches (12.7 cm) from the primary emitter. In one embodiment, the secondary emitter is supported by legs 34 having a selected length that maintain the spaced apart relationship between the primary and secondary emitter. FIG. 3. In another embodiment, the secondary emitter is placed directly on a cooking grate of a grill. In that construct, the grates maintain a spaced apart relationship between the primary emitter and the secondary emitter. Other types of mechanical frames of various construct may be used. The secondary emitter may have perforations or other apertures formed therein through which a portion of the infrared energy emitted from the primary emitter passes directly to the absorbing object(s). The apertures may be constructed to be closed or partially closed. In one embodiment, the secondary emitter is formed with two plates, each having apertures. The apertures may be aligned to show that the apertures are open, permitting the passage of energy through them. One plate may be moved relative to the second plate to close, or partially close the apertures.

A material used for most of the experimental secondary emitter plates is metal, which may be stainless steel. In other related experiments, various coatings have been applied to metal other than stainless steel. Other substrates, both coated and uncoated, that exhibit the required emissivity properties have been employed with equal success at required operating temperatures.

When the invention is used as preferred to lower radiative heat flux from the primary emitter 2 in a cooking or broiling application, means is provided to support the food 10 above the secondary emitter 4. FIG. 1; FIG. 2. The support member 12 is positioned above and is spaced apart from the secondary emitter. The construct of the support member (i.e. rack or grate) may vary according to the application, such as a particular grill construct. FIG. 3. The support member is characterized by the grate having openings that allow infrared energy to pass through the openings. More than 30% of the surface area of the support member is open, and more preferably, at least 50% of the surface area of the support member is open. This is contrasted with the secondary emitter, wherein the infrared energy is emitted from the plane of the secondary emitter and openings allow infrared energy from the primary emitter to pass through. Therefore, openings in the secondary emitter are less than 30% of the surface area in most applications, and the secondary emitter may not have any openings in the surface.

In some applications, the support member for food may be attached to the grill body, or the food support may be attached to the frame of the secondary emitter, with the plane of the support member generally parallel to the plane of the primary emitter and the secondary emitter.

What is claimed:

1. An infrared emission device providing reduction of radiative heat flux or intensity from a primary emitter, comprising:

a heat source;

a primary emitter that emits infrared radiation of a first wavelength;

a secondary emitter that is positioned above and spaced apart from the primary emitter, wherein the secondary emitter receives infrared radiation emitted from the primary emitter and emits infrared radiation, wherein the secondary emitter is constructed and arranged to emit infrared radiation having a wavelength that is longer than the infrared radiation of the first wavelength, and wherein the secondary emitter reduces the infrared energy emitted from the primary emitter to below a total emissive power of 936 BTU/HR FT$^2$ for all wavelengths.

2. An infrared emission device providing reduction of radiative heat flux or intensity from a primary emitter as described in claim 1, wherein not less than 50% of the infrared radiation emitted by the secondary emitter is of a wavelength that is longer than the first wavelength.

3. An infrared emission device providing reduction of radiative heat flux or intensity from a primary emitter as described in claim 1, wherein the secondary emitter comprises a plurality of apertures formed in a surface of the secondary emitter that allow passage of infrared radiation emitted by the primary emitter.

4. An infrared emission device providing reduction of radiative heat flux or intensity from a primary emitter as described in claim 1, wherein more than 50% of the wavelengths emitted by the secondary emitter are in excess of 8 microns.

5. An infrared emission device providing reduction of radiative heat flux or intensity from a primary emitter as described in claim 1, wherein the secondary emitter is coated with a heat tolerant coating that absorbs infrared energy and will withstand temperatures in excess of 271° C.

6. An infrared emission device providing reduction of radiative heat flux or intensity from a primary emitter as described in claim 1, wherein a lower side of the secondary emitter absorbs infrared energy.

7. An infrared emission device providing reduction of radiative heat flux or intensity from a primary emitter as described in claim 1, wherein a lower side of the secondary emitter comprises legs that extend from the lower side of the secondary emitter.

8. An infrared emission device providing reduction of radiative heat flux or intensity from a primary emitter as described in claim 1, wherein a support member is positioned above and is spaced apart from the secondary emitter, and wherein the support member receives infrared radiation from the secondary emitter.

9. An infrared emission device providing reduction of radiative heat flux or intensity from a primary emitter as described in claim 1, wherein a support member is positioned above and is spaced apart from the secondary emitter, and wherein the support member is a grate having openings formed therein, and wherein the support member receives infrared radiation from the secondary emitter.

10. An infrared emission device providing reduction of radiative heat flux or intensity from a primary emitter, comprising:

a heat source that emits a flame at an upper portion of the heat source;

a primary emitter that is positioned above the heat source and is spaced apart from the heat source, wherein the primary emitter emits infrared radiation of a first wavelength;

a secondary emitter that is positioned above and spaced apart from the primary emitter, wherein the secondary emitter receives infrared radiation emitted from the primary emitter and emits infrared radiation, wherein the secondary emitter is constructed and arranged to emit infrared radiation having a wavelength that is longer than the infrared radiation of the first wavelength.

11. An infrared emission device providing reduction of radiative heat flux or intensity from a primary emitter as described in claim 10, wherein the primary emitter has a generally planar shape and the secondary emitter is positioned generally parallel to the primary emitter.

12. An infrared emission device providing reduction of radiative heat flux or intensity from a primary emitter as described in claim 10, wherein an area of a lower surface of the secondary emitter is not materially larger than an area of a top surface of the primary emitter.

13. An infrared emission device providing reduction of radiative heat flux or intensity from a primary emitter as described in claim 10, wherein the secondary emitter is spaced apart from the primary emitter by not less than one-half (½") inch.

14. An infrared emission device providing reduction of radiative heat flux or intensity from a primary emitter as described in claim 10, further comprising a support member positioned above the secondary emitter, wherein the support member is constructed and arranged to receive food on an upper surface thereof for cooking of the food by infrared radiation received from the secondary emitter.

15. An infrared emission device providing reduction of radiative heat flux or intensity from a primary emitter as described in claim 10, wherein not less than 50% of the infrared radiation emitted by the secondary emitter is of a wavelength that is longer than the first wavelength.

16. An infrared emission device providing reduction of radiative heat flux or intensity from a primary emitter as described in claim 10, wherein the secondary emitter comprises a plurality of apertures formed in a surface of the secondary emitter that allow passage of infrared radiation emitted by the primary emitter.

17. An infrared emission device providing reduction of radiative heat flux or intensity from a primary emitter as described in claim 10, wherein more than 50% of the wavelengths emitted by the secondary emitter are in excess of 8 microns.

18. An infrared emission device providing reduction of radiative heat flux or intensity from a primary emitter as described in claim 10, wherein the secondary emitter is coated with a heat tolerant coating that absorbs infrared energy and will withstand temperatures in excess of 271° C.

19. An infrared emission device providing reduction of radiative heat flux or intensity from a primary emitter as described in claim 10 wherein a lower side of the secondary emitter absorbs infrared energy.

20. An infrared emission device providing reduction of radiative heat flux or intensity from a primary emitter as described in claim 10, wherein a lower side of the secondary emitter comprises legs that extend from the lower side of the secondary emitter.

21. An infrared emission device providing reduction of radiative heat flux or intensity from a primary emitter as described in claim 10, wherein the heat source is fueled by combustible gas.

22. An infrared emission device providing reduction of radiative heat flux or intensity from a primary emitter as described in claim 10, wherein a support member is positioned above and is spaced apart from the secondary emitter, and wherein the support member receives infrared radiation from the secondary emitter.

23. An infrared emission device providing reduction of radiative heat flux or intensity from a primary emitter as described in claim 10, wherein a support member is positioned above and is spaced apart from the secondary emitter, and wherein the support member is a grate having openings formed therein, and wherein the support member receives infrared radiation from the secondary emitter.

24. An infrared emission device providing reduction of radiative heat flux or intensity from a primary emitter, comprising:

a heat source;

a primary emitter that emits infrared radiation of a first wavelength;

a secondary emitter that is positioned above and spaced apart from the primary emitter, wherein the secondary emitter receives infrared radiation emitted from the primary emitter and emits infrared radiation, wherein the secondary emitter is constructed and arranged to emit infrared radiation having a wavelength that is longer than the infrared radiation of the first wavelength, and wherein a support member is positioned above and is spaced apart from the secondary emitter, and wherein the support member receives infrared radiation from the secondary emitter.

25. An infrared emission device providing reduction of radiative heat flux or intensity from a primary emitter as described in claim 24, wherein the support member is a grate having openings formed therein.

26. An infrared emission device providing reduction of radiative heat flux or intensity from a primary emitter as described in claim 24, wherein not less than 50% of the infrared radiation emitted by the secondary emitter is of a wavelength that is longer than the first wavelength.

27. An infrared emission device providing reduction of radiative heat flux or intensity from a primary emitter as described in claim 24, wherein the secondary emitter comprises a plurality of apertures formed in a surface of the secondary emitter that allow passage of infrared radiation emitted by the primary emitter.

28. An infrared emission device providing reduction of radiative heat flux or intensity from a primary emitter as described in claim 24, wherein more than 50% of the wavelengths emitted by the secondary emitter are in excess of 8 microns.

29. An infrared emission device providing reduction of radiative heat flux or intensity from a primary emitter as described in claim 24 wherein the secondary emitter is coated with a heat tolerant coating that absorbs infrared energy and will withstand temperatures in excess of 271° C.

30. An infrared emission device providing reduction of radiative heat flux or intensity from a primary emitter as described in claim 24, wherein a lower side of the secondary emitter absorbs infrared energy.

31. An infrared emission device providing reduction of radiative heat flux or intensity from a primary emitter as described in claim 24, wherein a lower side of the secondary emitter comprises legs that extend from the lower side of the secondary emitter.

32. An infrared emission device providing reduction of radiative heat flux or intensity from a primary emitter as described in claim 24, wherein an area of a lower surface of the secondary emitter is not materially larger than an area of a top surface of the primary emitter.

33. An infrared emission device providing reduction of radiative heat flux or intensity from a primary emitter as described in claim 24, wherein the secondary emitter is spaced apart from the primary emitter by not less than one-half (½") inch.

34. An infrared emission device providing reduction of radiative heat flux or intensity from a primary emitter as described in claim 24, further comprising a support member positioned above the secondary emitter, wherein the support member is constructed and arranged to receive food on an upper surface thereof for cooking of the food by infrared radiation received from the secondary emitter.

* * * * *